US011490482B1

(12) United States Patent
Fang

(10) Patent No.: US 11,490,482 B1
(45) Date of Patent: Nov. 1, 2022

(54) DIMMING REGULATED POWER SUPPLY MODULE AND LED DIMMING DEVICE

(71) Applicant: Shenzhen Angui Technology Co., Ltd., Shenzhen (CN)

(72) Inventor: Jifa Fang, Shenzhen (CN)

(73) Assignee: Shenzhen Angui Technology Co., Ltd.

( * ) Notice: Subject to any disclaimer, the term of this patent is extended or adjusted under 35 U.S.C. 154(b) by 0 days.

(21) Appl. No.: 17/330,613

(22) Filed: May 26, 2021

(51) Int. Cl.

| | |
|---|---|
| ***H05B 45/34*** | (2020.01) |
| ***H05B 45/32*** | (2020.01) |
| ***H05B 45/325*** | (2020.01) |
| ***H05B 45/392*** | (2020.01) |
| ***H05B 45/385*** | (2020.01) |
| ***H05B 45/375*** | (2020.01) |

(52) U.S. Cl.
CPC ..... *H05B 45/34* (2020.01); *H05B 45/325* (2020.01); *H05B 45/375* (2020.01); *H05B 45/385* (2020.01); *H05B 45/392* (2020.01)

(58) Field of Classification Search
CPC .... H05B 45/34; H05B 45/325; H05B 45/375; H05B 45/385; H05B 45/39
See application file for complete search history.

(56) References Cited

U.S. PATENT DOCUMENTS

| | | | | |
|---|---|---|---|---|
| 9,101,022 | B2 * | 8/2015 | Hoffman | H05B 45/38 |
| 10,667,349 | B2 * | 5/2020 | Lu | F21S 9/022 |
| 2009/0261748 | A1 * | 10/2009 | McKinney | H05B 45/375 315/307 |

OTHER PUBLICATIONS

Sully, Taylor,Perfect LED Retrofit Solution for Landscape Lighting Using a 12VAC Transformer Feb. 6, 2019, https://www.ledsupply.com/blog/switching-to-leds-with-an-outdoor-12vac-transformer-setup/; retrieved Apr. 22, 2022 (Year: 2019).*

* cited by examiner

*Primary Examiner* — Vibol Tan

(57) ABSTRACT

A dimming regulated power supply module comprising a control circuit, a voltage-stabilizing circuit, a dimming circuit, and an output port, wherein the control circuit converts city power into a supply voltage for supplying power to a LED light string through the output port, wherein the voltage-stabilizing circuit senses an internal voltage of the control circuit to generate a first voltage and a second voltage, and supplies power to a single-chip microcomputer in the dimming circuit after stabilizing the second voltage, wherein the voltage-stabilizing circuit outputs the first voltage to set the voltage range of the dimming circuit, wherein the output port transmits the dimming signal output by a dimmer to the dimming circuit, and wherein the dimming circuit generates a corresponding pulse-width modulation signal, wherein the control circuit controls the supply current according to the pulse-width modulation signal, thereby controls the brightness of the LED light string through the output port.

8 Claims, 9 Drawing Sheets

DIMMING REGULATED POWER SUPPLY MODULE AND LED DIMMING DEVICE

TECHNICAL FIELD

This invention generally relates to the technical field of electronics, and more particularly, to a dimming regulated power supply module and an LED dimming device.

BACKGROUND

Presently, there are three conventional technical solutions for designing LED power modules: an AC-DC circuit (using a constant voltage chip) plus a single-chip microcomputer or a DC-DC circuit (using a constant-current dimming chip), an AC-DC circuit (using a constant current chip) plus a de-flicker chip and a conversion dimming circuit, and an AC-DC circuit (using a constant current chip) plus a conversion dimming circuit, wherein a single-chip microcomputer is used to control the conversion dimming circuit.

However, the aforesaid designs adopt a large amount of chips and components, making the power module cumbersome while sharply increasing the cost. Meanwhile, when there is a need to output a constant current, the preceding circuit needs to output at least a constant voltage, which is equivalent to adding one more conversion circuit. When a constant current chip is used to supply power, due to the self-protection of the constant current chip, the power supply VCC turns into a triangular wave when there is no load, resulting in an unstable power supply. Thus, the conventional constant-current solutions fail to provide stable power supply for the single-chip microcomputer.

SUMMARY

The purpose of the present invention is to provide a dimming regulated power supply module and an LED dimming device, which effectively solves the problem relating to the failure of stably supplying power to the single-chip microcomputer.

To achieve the above purpose, the present invention adopts the following technical solution: a dimming regulated power supply module, which is connected to an LED light string and a dimmer, comprising a control circuit, a voltage-stabilizing circuit, a dimming circuit and an output port, wherein the control circuit converts the city power into a supply voltage for supplying power to the LED light string through the output port, wherein the voltage-stabilizing circuit senses the internal voltage of the control circuit to generate a first voltage and a second voltage, supplies power to the single-chip microcomputer in the dimming circuit after stabilizing the second voltage, and outputs the first voltage to set the voltage range of the dimming circuit, wherein the output port transmits the dimming signal output by the dimmer to the dimming circuit, and the dimming circuit generates a corresponding pulse-width modulation signal, wherein the control circuit controls the supply current according to the pulse-width modulation signal, thereby realizing the dimming control of the LED light string through the output port.

In another aspect of the present invention, the voltage-stabilizing circuit comprises a first diode, a second diode, a first capacitor, a second capacitor, a first triode, a second triode, a first resistor, a second resistor, a first voltage-stabilizing tube and a second voltage-stabilizing tube. The positive electrode of the first diode is respectively connected to the negative electrode of the second diode and the fifth pin of the transformer. The negative electrode of the first diode is respectively connected to one end of the first capacitor, one end of the first resistor and the collector electrode of the first triode. The other end of the first capacitor is respectively connected to the sixth pin of the transformer in the control circuit and one end of the second capacitor. The other end of the second capacitor is respectively connected to the positive electrode of the second diode and the dimming ground. The base electrode of the first triode is respectively connected to the other end of the first resistor and the negative electrode of the first voltage-stabilizing tube. The emitter electrode of the first triode is respectively connected to the first voltage end, the collector electrode of the second triode and one end of the second resistor. The emitter electrode of the second triode is connected to the second voltage end. The base electrode of the second triode is respectively connected to the other end of the second resistor and the negative electrode of the second voltage-stabilizing tube. The positive electrode of the first voltage-stabilizing tube and the positive electrode of the second voltage-stabilizing tube are both connected to the dimming ground.

In another aspect of the present invention, the voltage-stabilizing circuit further comprises a third resistor, a third capacitor and a fourth capacitor. The third resistor is connected in parallel with the second capacitor. One end of the third capacitor is respectively connected to the emitter electrode of the first triode and the first voltage end, and one end of the fourth capacitor is connected to one end of the second resistor. The other end of the third capacitor is connected to the other end of the fourth capacitor and the dimming ground.

In another aspect of the present invention, the dimming circuit comprises a first single-chip microcomputer, a first optocoupler, a third triode, a fourth triode, a fourth resistor, a fifth resistor, a sixth resistor, a seventh resistor and an eighth resistor. The VDD pin of the first single-chip microcomputer is connected to the second voltage end, the ADJ pin of the first single-chip microcomputer is respectively connected to one end of the fifth resistor and one end of the sixth resistor. The other end of the fifth resistor is respectively connected to one end of the fourth resistor and the first pin of the output port, and the other end of the fourth resistor is connected to the first voltage end. The other end of the sixth resistor and the GND pin of the first single-chip microcomputer are both connected to the dimming ground. The PWM pin of the first single-chip microcomputer is connected to the base electrode of the third triode, and the emitter electrode of the third triode is respectively connected to the dimming ground and the second pin of the first optocoupler. The collector electrode of the third triode is connected to the second voltage end and the first pin of the first optocoupler. The third pin of the first optocoupler is respectively connected to the emitter electrode of the fourth triode and the ground. The fourth pin of the first optocoupler is respectively connected to the base electrode of the fourth triode and one end of the seventh resistor. The collector electrode of the fourth triode is respectively connected to one end of the eighth resistor and the PWM pin of the dimming chip. The other end of the seventh resistor is respectively connected to the other end of the eighth resistor and a third voltage end.

In another aspect of the present invention, the dimming circuit further comprises a ninth resistor and a third voltage-stabilizing tube. One end of the ninth resistor is respectively connected to the other end of the fifth resistor and the first pin of the output port. The other end of the ninth resistor is connected to the negative electrode of the third voltage-stabilizing tube, and the positive electrode of the third voltage-stabilizing tube is connected to the other end of the sixth resistor.

In another aspect of the present invention, the dimming circuit further comprises a tenth resistor, a fifth capacitor and a sixth capacitor. One end of the tenth resistor is respectively connected to the ADJ pin of the first single-chip microcomputer and one end of the fifth capacitor. The other end of the tenth resistor is respectively connected to one end of the fifth resistor and one end of the sixth resistor, and the other end of the fifth capacitor is connected to the dimming ground. The sixth capacitor is connected between the VDD pin of the first single-chip microcomputer and the dimming ground.

In another aspect of the present invention, the dimming circuit further comprises an eleventh resistor, a twelfth resistor and a thirteenth resistor. The eleventh resistor is connected between the base electrode of the third triode and the PWM pin of the first single-chip microcomputer, the twelfth resistor is connected between the base electrode of the third triode and the emitter electrode of the third triode, and the thirteenth resistor is connected between the collector electrode of the third triode and the second voltage end.

In another aspect of the present invention, the voltage-stabilizing circuit in embodiment 2 comprises a third diode, a seventh capacitor, an eighth capacitor, a fifth triode, a sixth triode, a fourteenth resistor, a fifteenth resistor, a fourth voltage-stabilizing tube and a fifth voltage-stabilizing tube. The positive electrode of the third diode is connected to the fifth pin of the transformer. The negative electrode of the third diode is respectively connected to one end of the seventh capacitor, one end of the fourteenth resistor and the collector electrode of the fifth triode. The other end of the seventh capacitor is connected to one end of the eighth capacitor, and the other end of the eighth capacitor is respectively connected to the sixth pin of the transformer and the dimming ground. The base electrode of the fifth triode is respectively connected to the other end of the fourteenth resistor and the negative electrode of the fourth voltage-stabilizing tube. The emitter electrode of the fifth triode is respectively connected to the first voltage end, the collector electrode of the sixth triode and one end of the fifteenth resistor. The emitter electrode of the sixth triode is connected to the second voltage end, and the base electrode of the sixth triode is respectively connected to the other end of the fifteenth resistor and the negative electrode of the fifth voltage-stabilizing tube. The positive electrode of the fourth voltage-stabilizing tube and the positive electrode of the fifth voltage-stabilizing tube are both connected to the dimming ground.

In another aspect of the present invention, an LED dimming device of the present invention comprises a dimming regulated power supply module, an LED light string and a dimmer. The dimming regulated power supply module is connected to the LED light string and the dimmer. The dimming regulated power supply module supplies power to the LED light string after converting the city power into a supply voltage. The dimming regulated power supply module also generates a second voltage for supplying power to an internal single-chip microcomputer after stabilizing the second voltage. The dimmer outputs a corresponding dimming signal to the dimming regulated power supply module, and the dimming regulated power supply module realizes the dimming control of the LED light string according to the dimming signal.

Compared with the prior art, the present invention has the following advantages:

The present invention provides a dimming regulated power supply module and an LED dimming device. The dimming regulated power supply module comprises a control circuit, a voltage-stabilizing circuit, a dimming circuit and an output port. The control circuit converts the city power into a supply voltage for supplying power to the LED light string through the output port. The voltage-stabilizing circuit senses the internal voltage of the control circuit to generate a first voltage and a second voltage, supplies power to the single-chip microcomputer in the dimming circuit after stabilizing the second voltage, and outputs the first voltage to set the voltage range of the dimming circuit. The output port transmits the dimming signal output by the dimmer to the dimming circuit, and the dimming circuit generates a corresponding PWM signal. The control circuit controls the supply current according to the PWM signal, thereby realizing the dimming control of the LED light string through the output port. The present invention effectively solves the problem relating to the failure of supplying stable power to the single-chip microcomputer. Compared with the prior art, the output of the first voltage leaves a margin, thereby realizing the 0-10V dimming control.

DETAILED DESCRIPTION

Detailed embodiments are combined hereinafter to clearly and completely describe the techniques of the present invention. Obviously, the described embodiments are merely a representative part but not all of the embodiments of the present invention. The specification of the present invention allows those skilled in the art to obtain other embodiments without paying creative labor, and thus all of which shall fall into the scope of the present invention.

Figure 1:
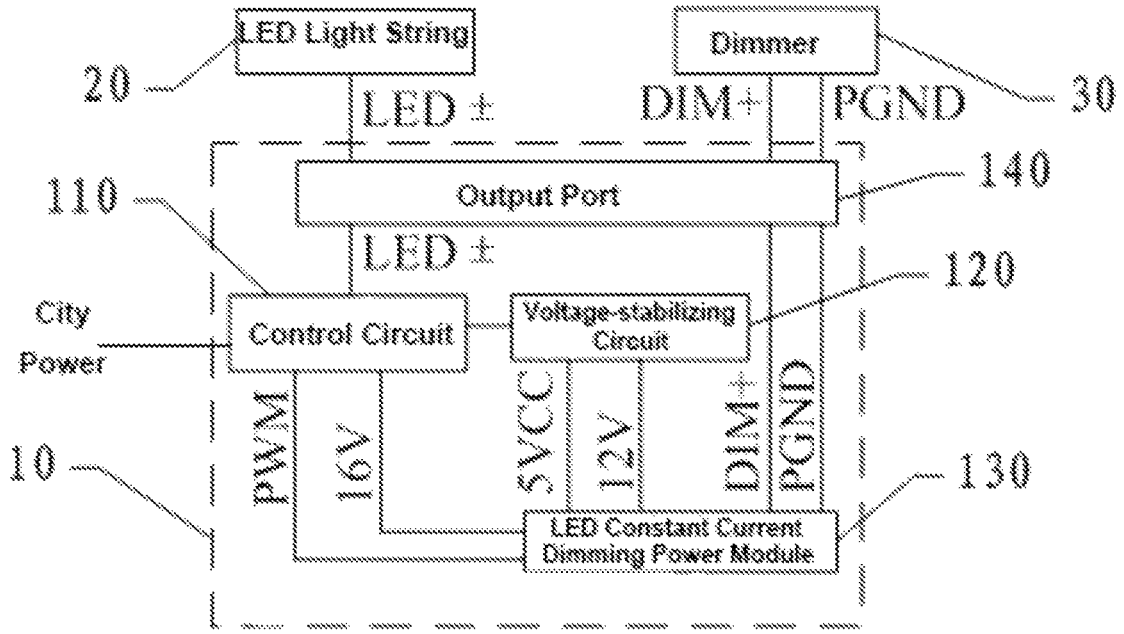
FIG. 1 is a structural diagram of the LED dimming device in embodiment 1 of the present invention.

As shown in FIG. 1, an LED dimming device of the present invention comprises a dimming regulated power supply module 10, an LED light string 20 and a dimmer 30. The dimming regulated power supply module 10 is connected to the LED light string 20 and the dimmer 30. The dimming regulated power supply module 10 supplies power to the LED light string 20 after converting the city power into a supply voltage (LED±). The dimming regulated power supply module 10 also generates a second voltage for supplying power to an internal single-chip microcomputer (based on different arrangements of pins, the single-chip microcomputer is divided into a first single-chip microcomputer and a second single-chip microcomputer) after stabilizing the second voltage. The dimmer 30 outputs a corresponding dimming signal DIM+ to the dimming regulated power supply module 10 according to a user's operation, and the dimming regulated power supply module 10 realizes the dimming control of the LED light string 20 according to the dimming signal DIM+.

In embodiment 1, as shown in FIG. 1, the dimming regulated power supply module 10 comprises a circuit board, wherein the circuit board is provided with a control circuit 110, a voltage-stabilizing circuit 120, a dimming circuit 130 and an output port 140. The control circuit 110 is connected to the voltage-stabilizing circuit 120, the dimming circuit 130 and the output port 140. The voltage-stabilizing circuit 120 is connected to the dimming circuit 130, the dimming circuit 130 is connected to the output port 140, and the output port 140 is connected to the LED light string 20 and the dimmer 30. The control circuit 110 converts the city power into a supply voltage LED± and a third voltage 16V, and outputs the supply voltage LED± through the output port 140, thereby supplying power to the LED light string. The voltage-stabilizing circuit 120 senses the voltage when the control circuit 110 is switched-on or switched-off, and then generates a first voltage of 12V and a second voltage of 5 VCC. After the second voltage of 5 VCC is stabilized, it is output to the single-chip microcomputer in the dimming circuit 130. The first voltage of 12V is output for setting the voltage range of the dimming circuit. The output port 140 transmits the dimming signal DIM+ output by the dimmer to the dimming circuit 130, and the dimming circuit 130 generates a corresponding PWM (Pulse-Width Modulation) signal according to the dimming signal DIM+. The control circuit 110 controls the supply current according to the PWM signal, thereby realizing the dimming control of the LED light string through the output port 140.

Figure 2:
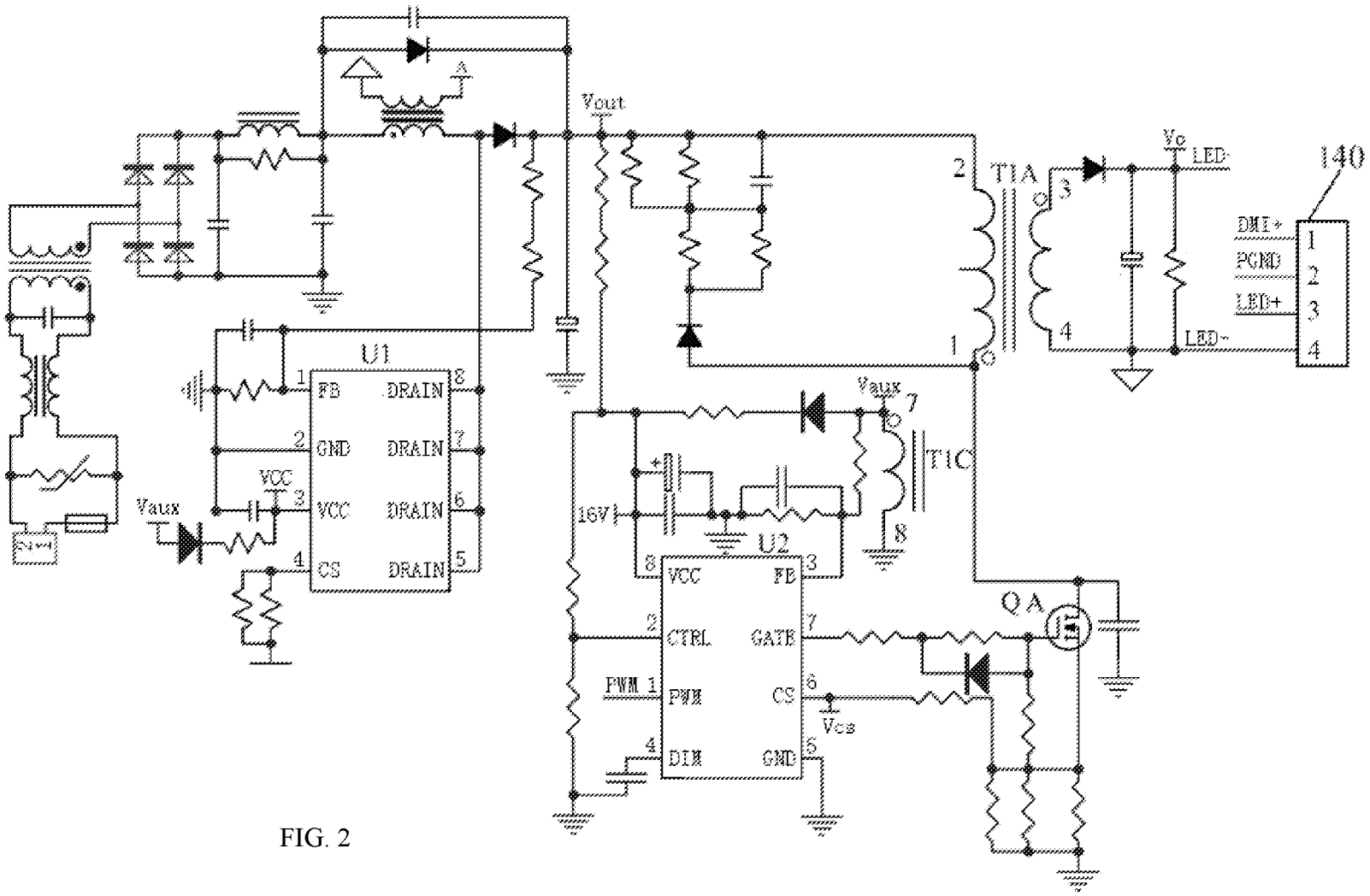
FIG. 2 is a circuit diagram of the control circuit and the output port in embodiment 1 of the present invention.

The control circuit 110 is shown in FIG. 2. The control circuit 110 belongs to the prior art, and thus the specific circuit connection is briefly described herein. As shown in FIG. 2, "A" represents a flying wire. After the city power is processed (e.g., rectified and filtered), it is supplied to a driver chip U1 whose model is preferably BP2636C. The driving chip U1 is used for realizing a constant-voltage driving, and the output voltage Vout supplies power to the dimming chip U2. The dimming chip U2 whose model is preferably BP3179F is an isolated low-PF dimming LED driving controller suitable for a flyback circuit, which supports PWM and analog dimming signals to simulate the whole dimming process. The GATE pin of the dimming chip U2 outputs a corresponding signal to control the on-off state of a first switch tube QA (which may be an NMOS tube). When the transformer (the model is preferably EF16 or EE16, comprising three coils which respectively are the first coil T1A, the second coil T1B and the third coil T1C) works, and when the first switch tube QA is turned on, the first pin of the transformer is pulled low, and the LED light string 20 is turned on. The dimming chip U2 also controls the waveform output by the CS pin according to the PWM (Pulse-Width Modulation) signal input by the dimming circuit 130, and adjusts the size of the output current, thereby realizing the dimming control of the LED light string (e.g., the control of brightness).

The output port 140 is a common port, and each pin of the output port 140 can be user-defined. The pins only play a role of signal transmission, which allow the LED light string and the dimmer to be conveniently connected to exterior by wires. The model of the output port is not limited herein.

Figure 3:
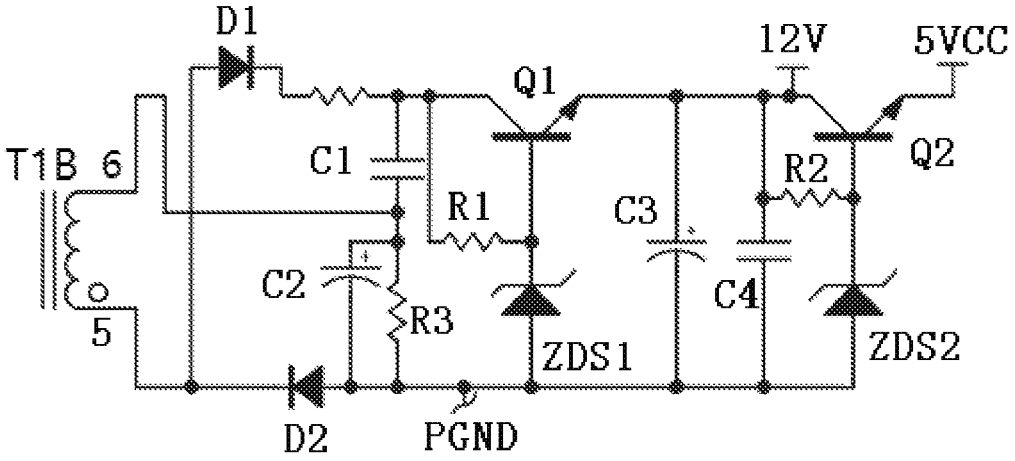
FIG. 3 is a circuit diagram of the voltage-stabilizing circuit in embodiment 1 of the present invention.

In embodiment 1, as shown in FIG. 3, the APFC (Active Power Factor Correction) and the flyback switching mode are controlled by the control circuit 110. Because the flyback output of the control circuit 110 adopts a constant-current control, the control circuit cannot output a constant voltage. In embodiment 1, the voltage-stabilizing circuit 120 is used to perform the voltage conversion and regulation by using the voltage on the second coil T1B of the transformer in the control circuit 110, thus stably supplying power to the first single-chip microcomputer in the dimming circuit 130.

The voltage-stabilizing circuit 120 comprises a first diode D1, a second diode D2, a first capacitor C1, a second capacitor C2, a first triode Q1, a second triode Q2, a first resistor R1, a second resistor R2, a first voltage-stabilizing tube ZDS1 and a second voltage-stabilizing tube ZDS2. The positive electrode of the first diode D1 is respectively connected to the negative electrode of the second diode D2 and the fifth pin of the transformer (namely, the homonymous terminal of the second coil T1B of the transformer). The negative electrode of the first diode D1 is respectively connected to one end of the first capacitor C1, one end of the first resistor R1 and the collector electrode of the first triode Q1. The other end of the first capacitor C1 is respectively connected to the sixth pin of the transformer in the control circuit (namely, the heteronymous terminal of the second coil T1B of the transformer) and one end of the second capacitor C2. The other end of the second capacitor C2 is respectively connected to the positive electrode of the second diode D2 and the dimming ground PGND. The base electrode of the first triode Q1 is respectively connected to the other end of the first resistor R1 and the negative electrode of the first voltage-stabilizing tube ZDS1. The emitter electrode of the first triode Q1 is respectively connected to the first voltage end (providing a first voltage of 12V), the collector electrode of the second triode Q2 and one end of the second resistor R2. The emitter electrode of the second triode Q2 is connected to the second voltage end (the second voltage 5 VCC whose output is 5V). The base electrode of the second triode Q2 is respectively connected to the other end of the second resistor R2 and the negative electrode of the second voltage-stabilizing tube ZDS2. The positive electrode of the first voltage-stabilizing tube ZDS1 and the positive electrode of the second voltage-stabilizing tube ZDS2 are both connected to the dimming ground PGND.

The dimming ground PGND is the ground electrode of the dimmer. The dimming ground PGND is connected to the second pin of the output port through a wire. The second capacitor C2 adopts an electrolytic capacitor, which is a polarized capacitor having a capacitance of 33 uF/100V. The first voltage-stabilizing tube ZDS1 is a voltage-stabilizing diode with a voltage-stabilizing value of 12V, and the second voltage-stabilizing tube ZDS2 is a voltage-stabilizing diode with a voltage-stabilizing value of 5V.

Through the first diode D1 and the second diode D2, the voltage sensed on the second coil T1B of the transformer in the whole power-switching process (i.e., on-off of the QA) is superimposed on the first capacitor C1 and the second capacitor C2 to ensure the stabilization of voltage on capacitor C2. The first triode Q1, the first resistor R1 and the first regulator ZDS1 form a voltage-stabilizing circuit, and the voltage on the second capacitor C2 is stabilized at 12V, thereby outputting the first voltage of 12V. The second triode Q2, the second resistor R2 and the second voltage-stabilizing tube ZDS2 form another voltage-stabilizing circuit. The second voltage 5 VCC on the second voltage end is stabilized at 5V, thereby outputting a second voltage of 5V to stably supply power to the first single-chip microcomputer in the dimming circuit 130.

Preferably, to improve the stability of the power supplied to the first single-chip microcomputer, the voltage-stabilizing circuit 120 further comprises a third resistor R3, a third capacitor C3 and a fourth capacitor C4. The third resistor R3 is connected in parallel with the second capacitor C2. One end of the third capacitor C3 is respectively connected to the emitter electrode of the first triode Q1 and the first voltage end, and one end of the fourth capacitor C4 is connected to one end of the second resistor R2. The other end of the third capacitor C3 is connected to the other end of the fourth capacitor C4 and the dimming ground PGND. The second voltage 5 VCC is generated by reducing the first voltage of 12V. The second voltage 5 VCC can be indirectly stabilized by stabilizing the first voltage of 12V through the filtering of capacitors C3 and C4. The third resistor R3 is used to limit the current of the first voltage-stabilizing tube ZDS1.

In the prior art, for the conventional LED power supply module does not have a voltage-stabilizing circuit 120, it only achieves a 1-10V dimming control due to the insufficient power supply. According to the present invention, the first voltage of 12V is output through the voltage-stabilizing circuit 120. For the first voltage leaves a margin of voltage amplitude, the dimming control ranging from 0 to 10V can be achieved, namely, the voltage range of the dimming circuit capable of being regulated from 0 to 10V. In the meantime, the voltage-stabilizing circuit 120 generates a stable second voltage 5 VCC for supplying power to the first single-chip microcomputer, which effectively solves the problem relating to the failure of supplying stable power to the first single-chip microcomputer by an LED power supply module.

Figure 4:
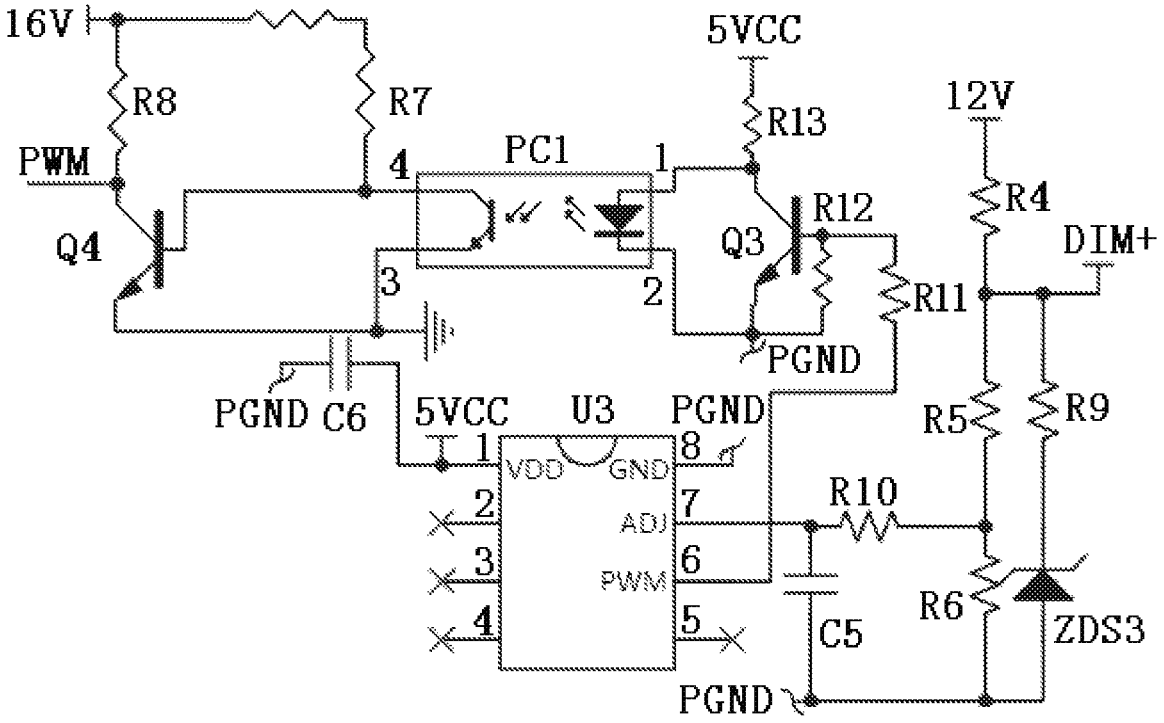
FIG. 4 is a circuit diagram of the dimming circuit in embodiment 1 of the present invention.

In embodiment 1, as shown in FIG. 4, the dimming circuit 130 comprises a first single-chip microcomputer U3, a first optocoupler PC1, a third triode Q3, a fourth triode Q4, a fourth resistor R4, a fifth resistor R5, a sixth resistor R6, a seventh resistor R7 and an eighth resistor R8. The VDD pin of the first single-chip microcomputer U3 is connected to the second voltage end, the ADJ pin of the first single-chip microcomputer U3 is respectively connected to one end of the fifth resistor R5 and one end of the sixth resistor R6. The other end of the fifth resistor R5 is respectively connected to one end of the fourth resistor R4 and the first pin of the output port 140, and the other end of the fourth resistor R4 is connected to the first voltage end. The other end of the sixth resistor R6 and the GND pin of the first single-chip microcomputer U3 are both connected to the dimming ground PGND. The PWM pin of the first single-chip microcomputer U3 is connected to the base electrode of the third triode Q3, and the emitter electrode of the third triode Q3 is respectively connected to the dimming ground PGND and the second pin of the first optocoupler PC1. The collector electrode of the third triode Q3 is connected to the second voltage end and the first pin of the first optocoupler PC1. The third pin of the first optocoupler PC1 is respectively connected to the emitter electrode of the fourth triode Q4 and the ground. The fourth pin of the first optocoupler PC1 is respectively connected to the base electrode of the fourth triode Q4 and one end of the seventh resistor R7. The collector electrode of the fourth triode Q4 is respectively connected to one end of the eighth resistor R8 and the PWM pin of the dimming chip U2. The other end of the seventh resistor R7 is respectively connected to the other end of the eighth resistor R8 and a third voltage end (outputting the third voltage of 16V).

The third triode Q3 and the fourth triode Q4 are NPN triodes. The model of the first single-chip microcomputer U3 is not limited as long as it is programmable. The sequence and function of each pin of the first single-chip microcomputer U2 can be set according to a program. Resistors R4-R6 are used for allowing the first single-chip microcomputer U3 to adjust and control the PWM signal, resistor R7 is used for supplying power to the first optocoupler PC1, and resistor R8 is used for performing the pull-up of the PWM signal.

When the externally-input dimming signal DIM+ is in high level, it is input into the ADJ pin of the first single-chip microcomputer after the voltage is divided by resistors R4-R6. The PWM pin of the first single-chip microcomputer outputs a low-level signal to control the third triode Q3 to be turned off. At this point, the first optocoupler PC1 is turned on, the fourth triode Q4 is turned off, and the PWM signal has a high-level output. When the dimming signal DIM+ is in low level, the PWM pin of the first single-chip microcomputer outputs a high-level signal to control the third triode Q3 to be turned on. At this point, the first optocoupler PC1 is turned off, the fourth triode Q4 is turned on, and the PWM signal has a low-level output.

The PWM signal is transmitted to the dimming chip U2 to control the output waveform of the CS pin, thereby adjusting the size of the output current and realizing the brightness adjustment of the LED light string.

Preferably, the dimming circuit 130 further comprises a ninth resistor R9 and a third voltage-stabilizing tube ZDS3. One end of the ninth resistor R9 is respectively connected to the other end of the fifth resistor R5 and the first pin of the output port 140. The other end of the ninth resistor R9 is connected to the negative electrode of the third voltage-stabilizing tube ZDS3, and the positive electrode of the third voltage-stabilizing tube ZDS3 is connected to the other end of the sixth resistor R6. Because the ADJ pin of the first single-chip microcomputer U3 has a relatively weak output, it is protected by a protection circuit composed of the ninth resistor R9 and the third voltage-stabilizing tube ZDS3.

Preferably, the dimming circuit 130 further comprises a tenth resistor R10, a fifth capacitor C5 and a sixth capacitor C6. One end of the tenth resistor R10 is respectively connected to the ADJ pin of the first single-chip microcomputer U3 and one end of the fifth capacitor C5. The other end of the tenth resistor R10 is respectively connected to one end of the fifth resistor R5 and one end of the sixth resistor R6, and the other end of the fifth capacitor C5 is connected to the dimming ground. The sixth capacitor C6 is connected between the VDD pin of the first single-chip microcomputer U3 and the dimming ground PGND. The tenth resistor R10 is used for adjusting the light sensitivity, thus better matching with the dimmer. The fifth capacitor C5 is used for filtering out the external sensitive signals, and the sixth capacitor C6 is used for filtering the second voltage 5 VCC input into the first single-chip microcomputer, thereby further enhancing the stability of the power supply to the first single-chip microcomputer.

Preferably, the dimming circuit 130 further comprises an eleventh resistor R11, a twelfth resistor R12 and a thirteenth resistor R13. The eleventh resistor R11 is connected between the base electrode of the third triode Q3 and the PWM pin of the first single-chip microcomputer U3, the twelfth resistor R12 is connected between the base electrode of the third triode Q3 and the emitter electrode of the third triode Q3, and the thirteenth resistor R13 is connected between the collector electrode of the third triode Q3 and the second voltage end. Because the signal output by the PWM pin of the first single-chip microcomputer U3 is weak, the third triode Q3 can be controlled through the eleventh resistor R11, thereby realizing a more stable on-off. The pull-down action of the twelfth resistor R12 ensures that the third triode Q3 is completely turned off when it is left idle, and the thirteenth resistor R13 is used for supplying power to the collector electrode (equivalent to the first pin of the first optocoupler) of the third triode Q3.

In embodiment 2, as shown in FIG. 2, the circuit and the working principle of the control circuit 110 in embodiment 2 are the same as that in embodiment 1, and as shown in FIG. 4, the circuit and the working principle of the dimming circuit 130 in embodiment 2 are the same as that in embodiment 1.

Figure 5:
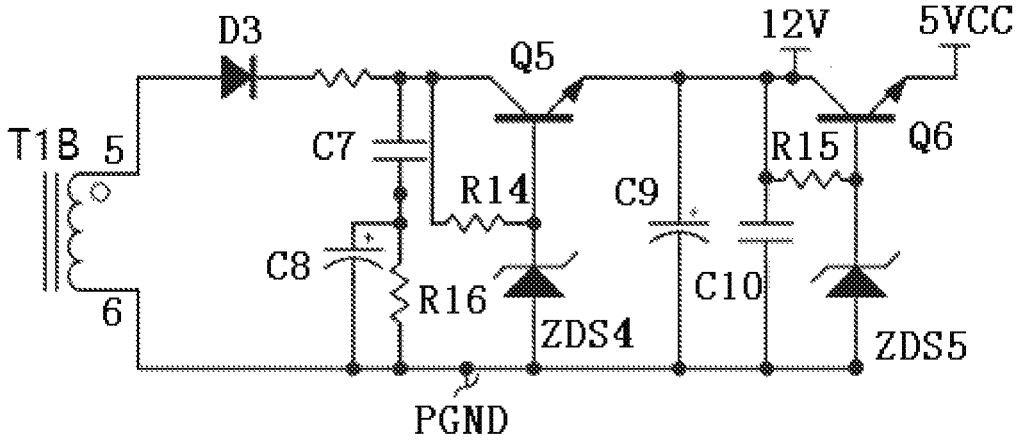
FIG. 5 is a circuit diagram of the voltage-stabilizing circuit in embodiment 2 of the present invention.

Embodiment 2 makes improvements based on embodiment 1. As shown in FIG. 5, the voltage-stabilizing circuit in embodiment 2 comprises a third diode D3, a seventh capacitor C7, an eighth capacitor C8, a fifth triode Q5, a sixth triode Q6, a fourteenth resistor R14, a fifteenth resistor R15, a fourth voltage-stabilizing tube ZDS4 and a fifth voltage-stabilizing tube ZDS5. The positive electrode of the third diode D3 is connected to the fifth pin of the transformer (equivalent to the homonymous terminal of the second coil T1B of the transformer). The negative electrode of the third diode D3 is respectively connected to one end of the seventh capacitor C7, one end of the fourteenth resistor R14 and the collector electrode of the fifth triode Q5. The other end of the seventh capacitor C7 is connected to one end of the eighth capacitor C8, and the other end of the eighth capacitor C8 is respectively connected to the sixth pin of the transformer (namely, the heteronymous terminal of the second coil T1B of the transformer) and the dimming ground PGND. The base electrode of the fifth triode Q5 is respectively connected to the other end of the fourteenth resistor R14 and the negative electrode of the fourth voltage-stabilizing tube ZDS4. The emitter electrode of the fifth triode Q5 is respectively connected to the first voltage end (outputting the first voltage of 12V), the collector electrode of the sixth triode Q6 and one end of the fifteenth resistor R15. The emitter electrode of the sixth triode Q6 is connected to the second voltage end (outputting the second voltage of 5V), and the base electrode of the sixth triode Q6 is respectively connected to the other end of the fifteenth resistor R15 and the negative electrode of the fifth voltage-stabilizing tube ZDS5. The positive electrode of the fourth voltage-stabilizing tube ZDS4 and the positive electrode of the fifth voltage-stabilizing tube ZDS5 are both connected to the dimming ground PGND.

Through the third diode D3, the voltage sensed on the second coil T1B of the transformer in the whole power-switching process (i.e., on-off of the QA) is superimposed on the seventh capacitor C7 and the eighth capacitor C8 to ensure the stabilization of the voltage on capacitor C8. The fifth triode Q5, the fourteenth resistor R14 and the fourth regulator ZDS4 form a voltage-stabilizing circuit, and the voltage on the eighth capacitor C8 is stabilized at 12V, thereby outputting the first voltage of 12V. The sixth triode Q5, the fifteenth resistor R15 and the fifth voltage-stabilizing tube ZDS5 form another voltage-stabilizing circuit. The second voltage 5 VCC on the second voltage end is stabilized at 5V, thereby outputting a second voltage of 5V to stably supply power to the first single-chip microcomputer in the dimming circuit 130.

Preferably, to improve the stability of the power supplied to the first single-chip microcomputer, in embodiment 2, the voltage-stabilizing circuit 120 further comprises a sixteenth resistor R16, a ninth capacitor C9 and a tenth capacitor C10. The sixteenth resistor R16 is connected in parallel with the eighth capacitor C8. One end of the ninth capacitor C9 is respectively connected to the emitter electrode of the fifth triode Q5 and the first voltage end, and one end of the tenth capacitor C10 is connected to one end of the fifteenth resistor R15. The other end of the ninth capacitor C9 is respectively connected to the other end of the tenth capacitor C10 and the dimming ground PGND. The second voltage 5 VCC is generated by reducing the first voltage of 12V. The second voltage 5 VCC can be indirectly stabilized by stabilizing the first voltage of 12V through the filtering of capacitors C9 and C10. The sixteenth resistor R16 is used to limit the current of the first voltage-stabilizing tube ZDS1.

To guarantee the isolation, it is necessary to ensure that the distance is safe and the withstand voltage meets the standard. In embodiment 2, a three-layer insulated wire is used on the fifth pin of the transformer to ensure that there is a sufficient distance between the second coil T1B of the transformer and the primary side of the whole power supply.

It should be noted that, as shown in embodiments 3-5, the embodiments mainly focus on improving the voltage-stabilizing circuit in the dimming regulated power supply module of the present invention. The improved voltage-stabilizing circuit can be used together with various control circuits to stably supply power to the first single-chip microcomputer in the dimming circuit.

Figure 6:
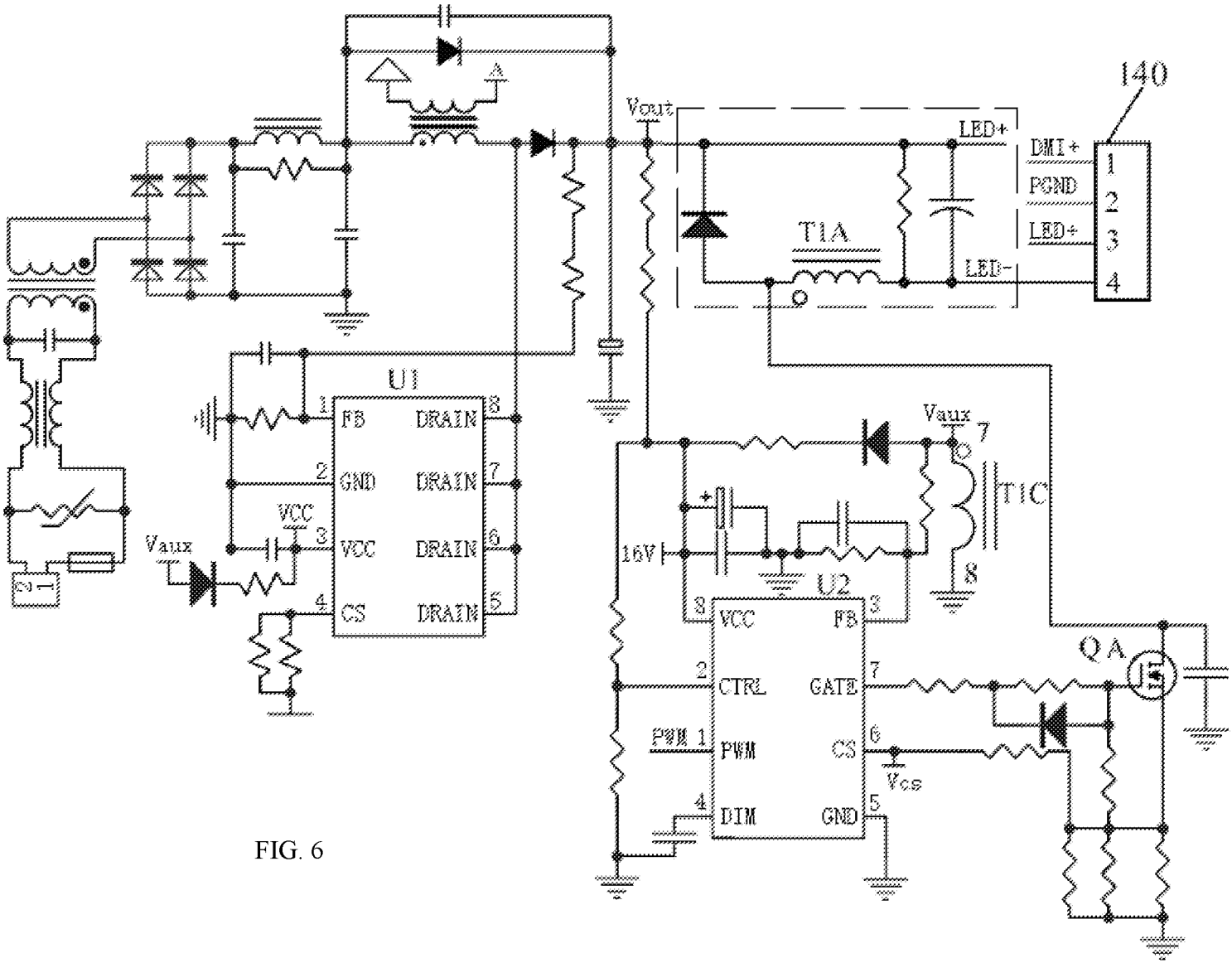
FIG. 6 is a circuit diagram of the control circuit and the output port in embodiment 3 of the present invention.

In embodiment 3, the control circuit is replaced by the APFC (Active Power Factor Correction)+BUCK (step-down circuit) circuit shown in FIG. 6. Through utilizing the constant voltage output of APFC, the power is stably supplied to the first single-chip microcomputer needing a constant voltage output. Embodiment 3 is a variant of embodiment 2. The difference between the two embodiments lies in the first coil T1A of the transformer and its peripheral circuit (as shown in the dotted box in FIG. 6, the third and fourth pins of the transformer are no longer used in embodiment 3). As shown in FIG. 6, other circuit structures of the two embodiments are the same (the names of the devices in the same portion are the same as those in embodiment 2, indicating that they are the same devices). This belongs to the prior art, and thus the circuit connection is not described in detail herein. The voltage-stabilizing circuit in embodiment 3 can adopt the voltage-stabilizing circuit in embodiment 2. To save cost, the seventh capacitor C7 can be replaced by using a connecting wire, and the rest of the circuit remains unchanged. The dimming circuit in embodiment 3 is the same as that in embodiment 2 shown in FIG. 4.

Figure 7:
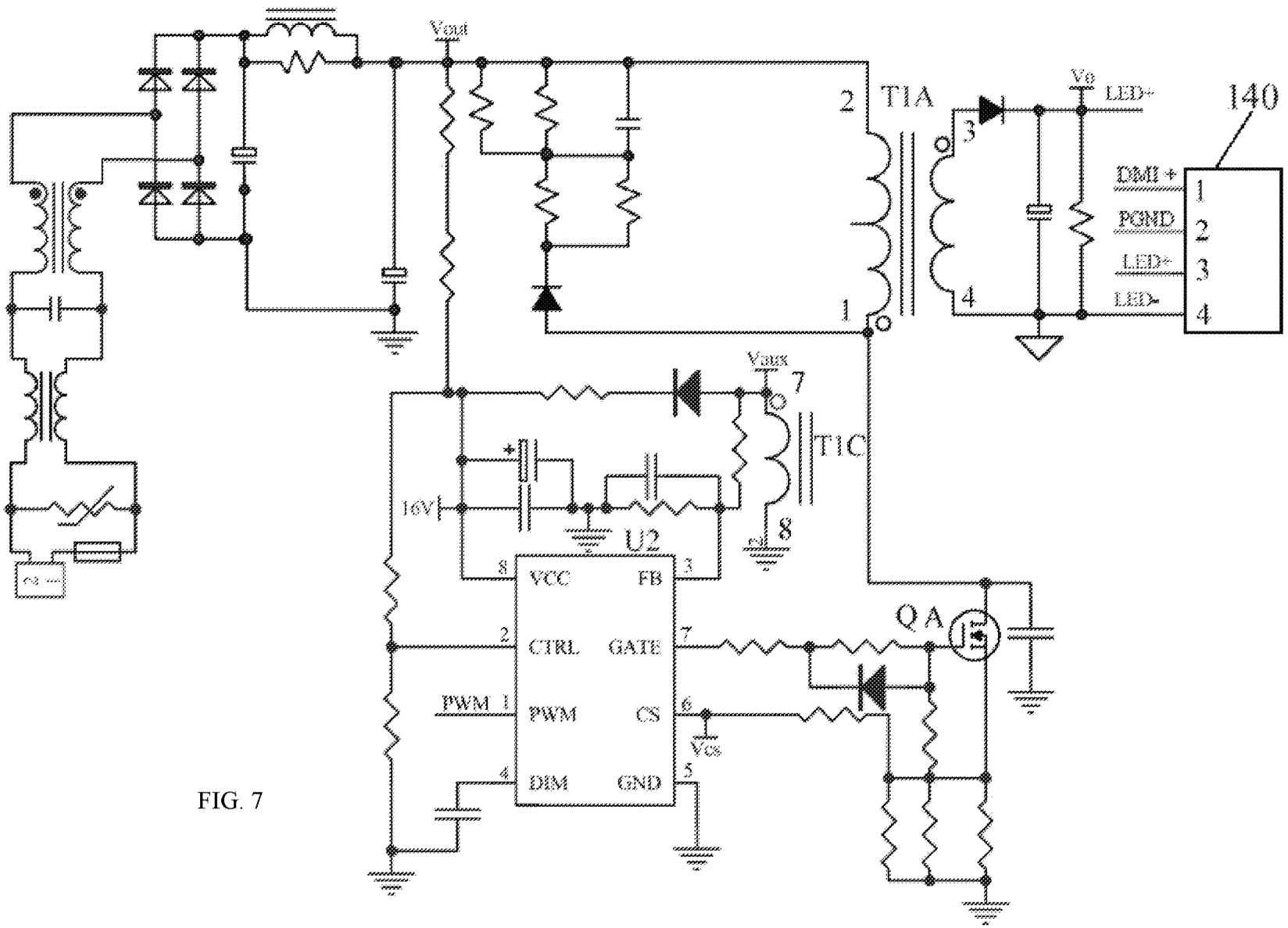
FIG. 7 is a circuit diagram of the control circuit and the output port in embodiment 4 of the present invention.

In embodiment 4, the control circuit is replaced by a constant-current single-stage low PF (power factor) isolated circuit shown in FIG. 7. Embodiment 4 is a variant of embodiment 1. The different between the two embodiments is that the driving chip U1 and its peripheral circuit are removed in embodiment 4. Other circuit structures of the two embodiments are the same (the names of the devices in the same portion are the same as those in embodiment 2, indicating that they are the same devices). This belongs to the prior art, and thus the circuit connection is not described in detail herein. For the control circuit in embodiment 4 can only achieve a dimming control ranging from 1 to 10V, the voltage-stabilizing circuit in embodiment 4 can adopt the voltage-stabilizing circuit in embodiment 1 shown in FIG. 3. In this way, the voltage is superimposed to output the first voltage of 12V, thereby leaving a margin to realize the 0-10V dimming control. The dimming circuit in embodiment 4 is the same as that in embodiment 1 shown in FIG. 4.

Figure 8:
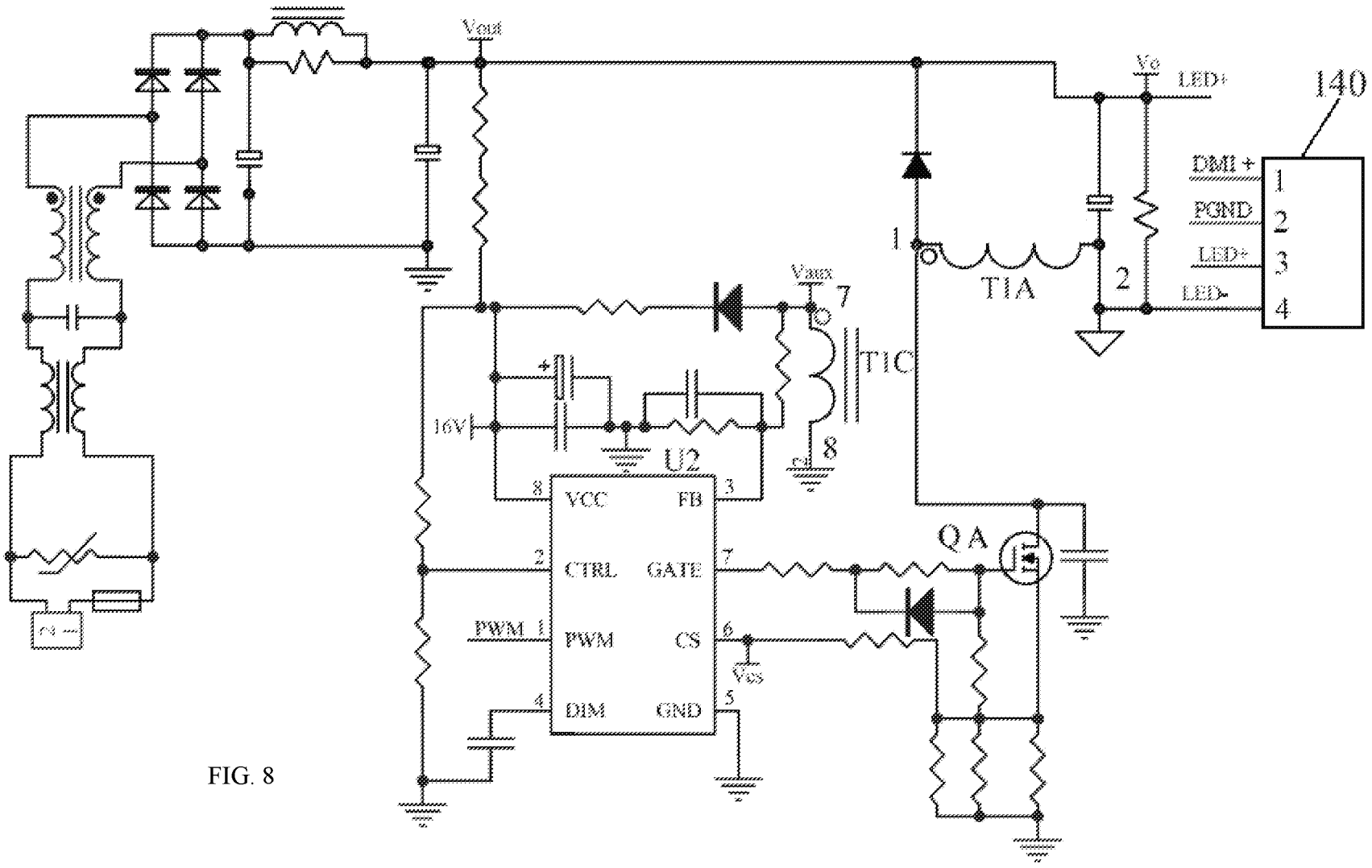
FIG. 8 is a circuit diagram of the control circuit and the output port in embodiment 5 of the present invention.

In embodiment 5, the control circuit is replaced by a constant-current single-stage low PF (power factor) non-isolated circuit shown in FIG. 8. Embodiment 5 is a variant of embodiment 1. The different between the two embodiments is that: the driving chip U1 and its peripheral circuit are removed, and the first coil TIA of the transformer and its peripheral circuit are different (the third and fourth pins of the transformer are no longer used in embodiment 5). Other circuit structures of the two embodiments are the same (the names of the devices in the same portion are the same as those in embodiment 2, indicating that they are the same devices). This belongs to the prior art, and thus the circuit connection is not described in detail herein. For the control circuit in embodiment 5 can only achieve a dimming control ranging from 1 to 10V, the voltage-stabilizing circuit in embodiment 5 can adopt the voltage-stabilizing circuit in embodiment 1 shown in FIG. 3. In this way, the voltage is superimposed to output the first voltage of 12V, thereby leaving a margin to realize the 0-10V dimming control. The dimming circuit in embodiment 5 is the same as that in embodiment 1 shown in FIG. 4.

In embodiment 6, the voltage-stabilizing circuit and the dimming circuit are improved. The control circuit may be any of the circuits shown in FIGS. 1, 6, 7 and 8 as long as it is provided with a dimming chip U2.

Figure 9:
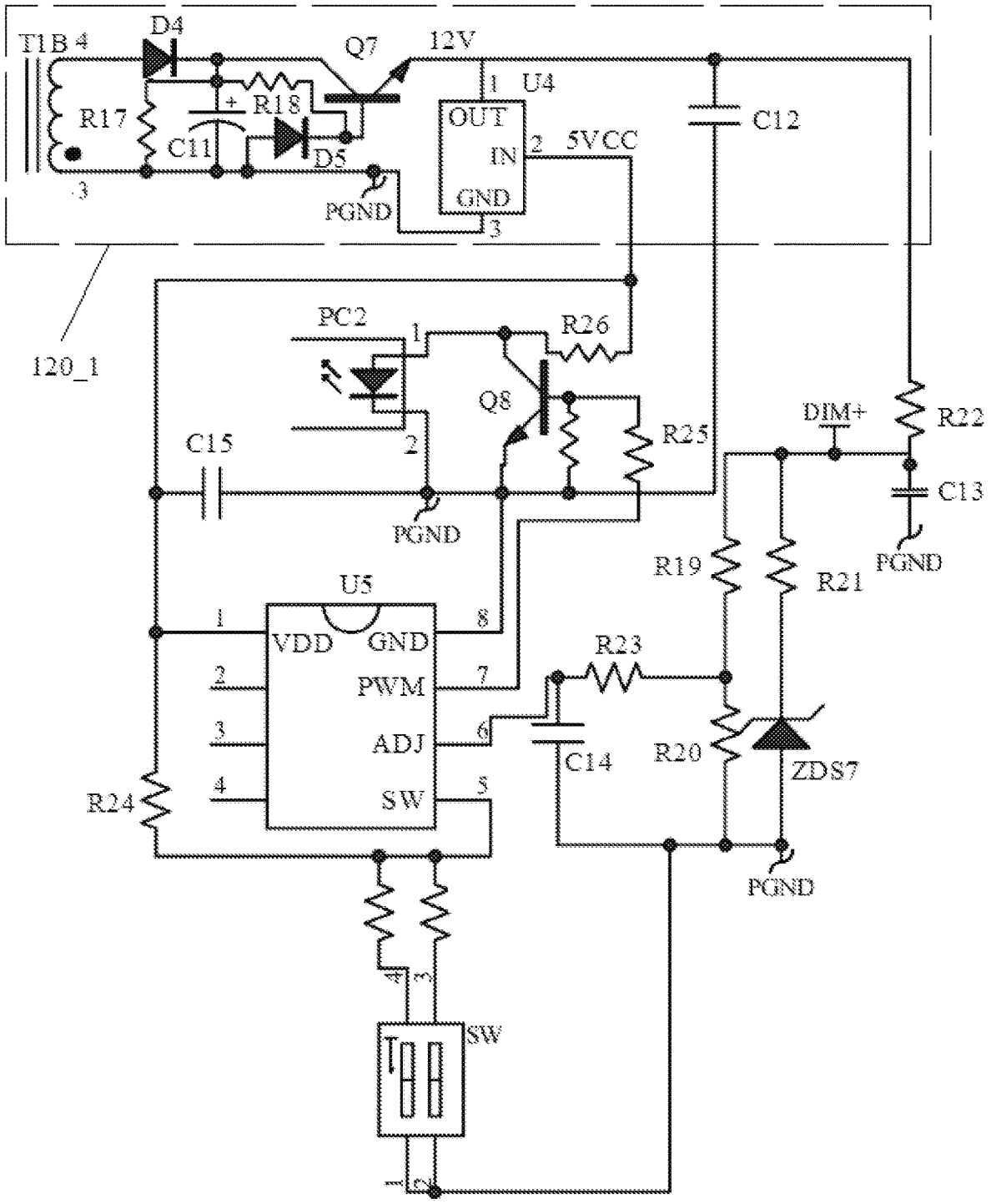
FIG. 9 is a circuit diagram of the voltage-stabilizing circuit and a part of the dimming circuit in embodiment 6 of the present invention.

As shown in FIG. 9, in embodiment 6, the voltage-stabilizing circuit (denoted here by reference numeral 120_1/) comprises a voltage regulator U4, a fourth diode D4, a fifth diode D5, a seventh triode Q7, a seventeenth resistor R17, an eighteenth resistor R18, an eleventh capacitor C11 and a twelfth capacitor C12. The positive electrode of the fourth diode D4 is connected to the fourth pin of the transformer (namely, the heteronymous terminal of the second coil T1B of the transformer). The negative electrode of the fourth diode D4 is respectively connected to the collector electrode of the seventh triode Q7, one end of the eleventh capacitor C11, one end of the seventeenth resistor R17 and one end of the eighteenth resistor R18. The base electrode of the seventh triode Q7 is connected to the negative electrode of the fifth diode D5 and the other end of the eighteenth resistor R18. The positive electrode of the fifth diode D5 is respectively connected to the other end of the eleventh capacitor C11, the other end of the seventeenth resistor R17, the third pin of the transformer (namely, the homonymous terminal of the second coil T1B of the transformer) and the dimming ground PGND. The OUT pin (namely, the output pin) of the voltage regulator U4 is respectively connected to the emitter electrode of the seventh triode Q7, one end of the twelfth capacitor C12 and the dimming circuit (embodiment 6). The IN pin (namely, the input pin) of the voltage regulator U4 is connected to the dimming circuit (embodiment 6), the GND pin (ground pin) of the voltage regulator U4 is connected to the dimming ground PGND, and the other end of the twelfth capacitor C12 is connected to the dimming circuit (embodiment 6).

The model of the voltage regulator U4 is preferably 78L05. The voltage sensed on the second coil T1B of the transformer is superposed on the eleventh capacitor C11 through the fourth diode D4, thereby realizing the stabilization of the voltage on the eleventh capacitor C11. The seventh triode Q7 is used for linearly stabilizing the voltage. The voltage on the eleventh capacitor C11 is stabilized at 12V, thereby outputting the first voltage of 12V and providing a pull-up high level to the dimming signal DIM+. The voltage regulator U4 outputs a second voltage 5 VCC according to the first voltage, and the voltage is stabilized at 5V to stably supply power to the second single-chip microcomputer in the dimming circuit.

Figure 10:
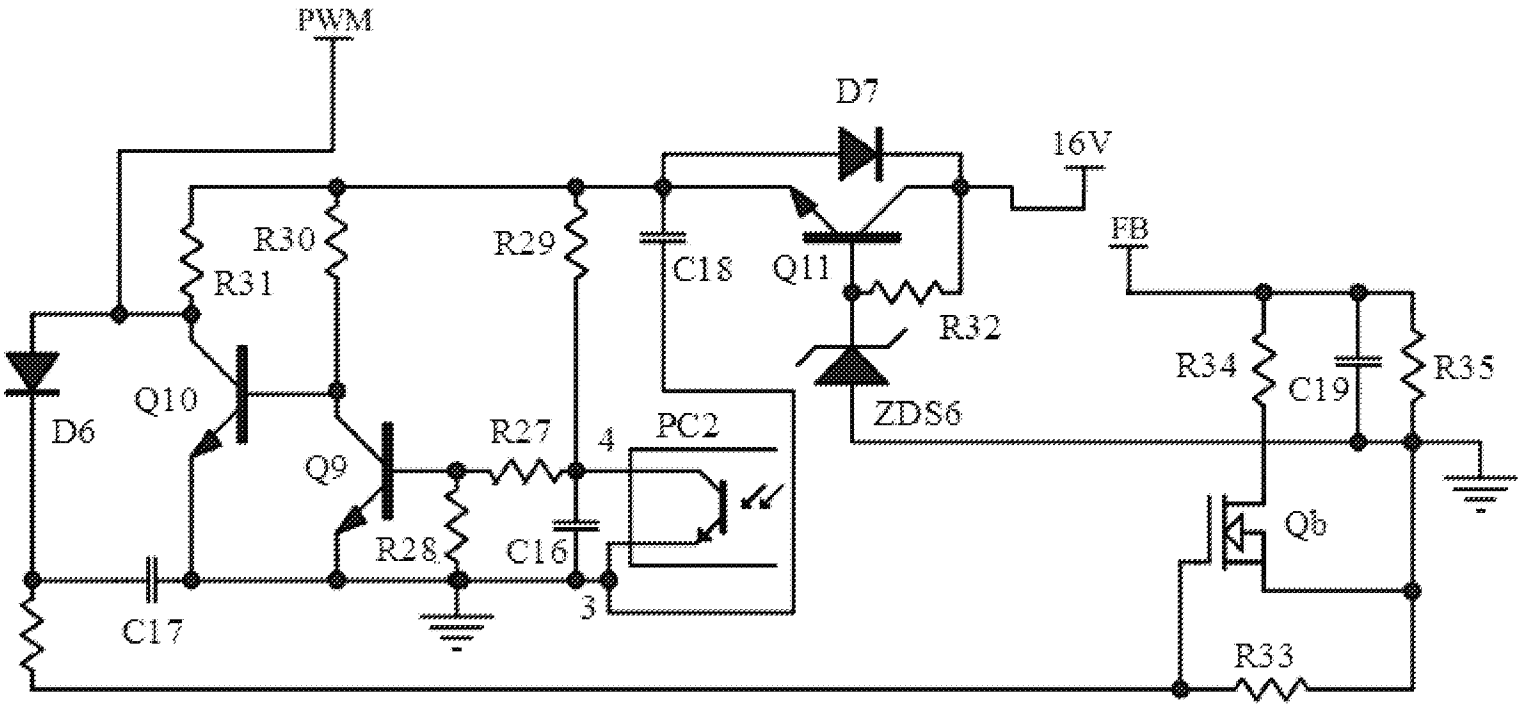
FIG. 10 is a circuit diagram of another part of the dimming circuit in embodiment 6 of the present invention.

As shown in FIGS. 9-10, in embodiment 6, the dimming circuit comprises a second single-chip microcomputer U5, a second optocoupler PC2, a sixth voltage-stabilizing tube ZDS6, an eighth triode Q8, a ninth triode Q9, a tenth triode Q10, an eleventh triode Q11, a second switching tube QB, a sixth diode D6, a nineteenth resistor R19 and a twentieth resistor R20. The VDD pin of the second single-chip microcomputer U5 is respectively connected to the IN pin of the voltage regulator U4, the first pin of the second optocoupler PC2 and the collector electrode of the eighth triode Q8. The GND pin of the second single-chip microcomputer U5 is respectively connected to the dimming ground PGND, the emitter electrode of the eighth triode Q8 and the second pin of the second optocoupler PC2. The PWM pin of the second single-chip microcomputer U5 is connected to the base electrode of the eighth triode Q8, and the ADJ pin of the second single-chip microcomputer U5 is respectively connected to one end of the nineteenth resistor R19 and one end of the twentieth resistor R20. The other end of the nineteenth resistor R19 is respectively connected to the OUT pin of the voltage regulator U4 and the first pin (for transmitting the dimming signal DIM+) of the output port 140. The other end of the twentieth resistor R20 is connected to the dimming ground PGND. The SW pin of the second single-chip microcomputer U5 is connected to the VDD pin of the second single-chip microcomputer U5, and the third pin of the second optocoupler PC2 is respectively connected to the emitter electrode of the ninth triode Q9, the emitter electrode of the tenth triode Q10 and the ground. The fourth pin of the second optocoupler PC2 is respectively connected to the base electrode of the ninth triode Q9, the collector electrode of the ninth triode Q9 and the emitter electrode of the eleventh triode Q11. The base electrode of the tenth triode Q10 is respectively connected to the collector electrode of the ninth triode Q9, the collector electrode of the tenth triode Q10, the positive electrode of the sixth diode D6 and the DIM pin of the power supply control chip U1 (for transmitting the PWM signal). The negative electrode of the sixth diode D6 is respectively connected to the grid electrode of the second switching tube QB, the source electrode of the second switching tube QB and the ground. The base electrode of the eleventh triode Q11 is respectively connected to the collector electrode of the eleventh triode Q11, the negative electrode of the sixth voltage-stabilizing tube ZDS6 and the power supply end (the third voltage of 16V provided by the VCC pin of the dimming chip U2). The positive electrode of the sixth voltage-stabilizing tube ZDS6 is respectively connected to the source electrode of the second switching tube QB and the ground, and the drain electrode of the second switching tube QB is connected to the FB pin of the dimming chip U2.

The model of the second single-chip microcomputer U5 is not limited as long as it is programmable. The sequence and function of each pin of the second single-chip microcomputer U5 can be set according to a program. Resistors R19-R20 are used for allowing the second single-chip microcomputer to adjust and control the PWM signal. The ninth triode Q9 and the tenth triode Q10 are used for amplifying the PWM signal and then transmitting the PWM signal to the DIM pin of the dimming chip U2. The eleventh pole Q11 is used for linearly stabilizing the voltage. For the base electrode and the emitter electrode of the eleventh triode Q11 are pulled high by the third voltage of 16V, the eleventh triode Q11 remains on, and the third voltage of 16V is output from the emitter electrode of the eleventh triode Q11. The second switching tube QB is an OVP tube.

When the dimming signal DIM+ is in high level, it is input into the ADJ pin of the second single-chip microcomputer after the voltage is divided by resistors R19-R20. The PWM pin of the second single-chip microcomputer outputs a low-level signal to control the eighth triode Q8 to be turned on. At this point, the second optocoupler PC2 is turned off, the base electrode of the ninth triode Q9 is pulled up and turned on through the third voltage of 16V, the base electrode of the tenth triode Q10 is pulled down to a low level, and the PWM signal has a high-level output (pulled up by the third voltage of 16V). When the dimming signal DIM+ is in low level, the PWM pin of the second single-chip microcomputer outputs a low-level signal to control the eighth triode Q8 to be turned off. At this point, the second optocoupler PC2 is turned on, the base electrode of the ninth triode Q9 is pulled down and turned off, the base electrode of the tenth triode Q10 is pulled up and turned on through the third voltage of 16V, and the PWM signal has a low-level output (pulled down by the tenth triode Q10). In this way, the corresponding PWM signal can be output when the dimming signal DIM+ periodically varies between high and low levels. The dimming chip U2 also controls the waveform output by the CS pin according to the PWM for adjusting the size of the output current, thereby realizing the dimming control of the LED light string.

When the PWM signal is in high level, the sixth diode D6 (unidirectionally turned on) controls the second switching tube QB to be turned on. When the PWM signal is in low level, for the grid electrode of the second switching tube QB is connected to the ground, the second switching tube QB is turned off. In this way, when dimming at low brightness or outputting no-load voltage, the maximum output voltage is controlled by the second switching QB. Meanwhile, by using the third voltage of 16V to provide a high level, the transformer can output the third voltage of 16V first and then regenerate a PWM signal, thereby preventing the power failure when being initiated.

Preferably, the dimming circuit further comprises a seventh voltage-stabilizing tube ZDS7, a thirteenth capacitor C13, a fourteenth capacitor C14, a twenty-first resistor R21, a twenty-second resistor R22 and a twenty-third resistor R23. The positive electrode of the seventh voltage-stabilizing tube ZDS7 is connected to the dimming ground, and the negative electrode of the seventh voltage-stabilizing tube ZDS7 is respectively connected to one end of the twenty-second resistor R22 and one end of the thirteenth capacitor C13 through the twenty-first resistor R21. The other end of the twenty-second resistor R22 is connected to the OUT pin of the voltage regulator U4, and the other end of the thirteenth capacitor C13 is connected to the dimming ground. One end of the twenty-third resistor R23 is respectively connected to one end of the nineteenth resistor R19 and one end of the twenty-fourth resistor R20. The other end of the twenty-third resistor R23 is connected to one end of the second single-chip microcomputer U5 and one end of the fourteenth capacitor C14. The other end of the fourteenth capacitor C14 is connected to the dimming ground.

The seventh voltage-stabilizing tube ZDS7 and the twenty-first resistor R21 are used for stabilizing the dimming signal DIM+. The twenty-second resistor R22 and the thirteenth capacitor C13 are used for filtering the dimming signal DIM+. The twenty-third resistor R23 and the fourteenth capacitor C14 are used for filtering the divided voltage of the dimming signal DIM+.

Preferably, the dimming circuit further comprises a fifteenth capacitor C15, a twenty-fourth resistor R24, a twenty-fifth resistor R25 and a twenty-sixth resistor R26. One end of the fifteenth capacitor C15 is connected to the VDD pin of the second single-chip microcomputer U5, and one end of the twenty-fourth resistor R24 is connected to the IN pin of the voltage regulator U4. The other end of the fifteenth capacitor C15 is respectively connected to the dimming ground and the second pin of the second optocoupler PC2. The other end of the twenty-fourth resistor R24 is connected to the SW pin of the second single-chip microcomputer U5. One end of the twenty-fifth resistor R25 is connected to the PWM pin of the second single-chip microcomputer U5, and the other end of the twenty-fifth resistor R25 is connected to the base electrode of the eighth triode Q8. One end of the twenty-sixth resistor R26 is connected to the IN pin of the voltage regulator U4, and the other end of the twenty-sixth resistor R26 is respectively connected to the first pin of the second optocoupler PC2 and the collector electrode of the eighth triode Q8.

The fifteenth capacitor C15 is used for filtering the second voltage 5 VCC, thus making the operation of the second single-chip microcomputer more stable. The twenty-fourth resistor R24 is used for protecting the SW pin, the twenty-fifth resistor R25 is used for protecting the eighth triode Q8 (protecting the eighth triode Q8 from being damaged by a sudden high voltage), and the twenty-sixth resistor R26 is used for protecting the second optocoupler PC2 (protecting the second optocoupler PC2 from being damaged by the excessively-high second voltage 5 VCC while stably supplying power to the second optocoupler PC2).

Preferably, the dimming circuit further comprises a sixteenth capacitor C16, a seventeenth capacitor C17, a twenty-seventh resistor R27, a twenty-eighth resistor R28, a twenty-ninth resistor R29, a thirtieth resistor R30 and a thirty-first resistor R31. One end of the sixteenth capacitor C16 is respectively connected to one end of the second optocoupler PC2, one end of the twenty-seventh resistor R27 and one end of the twenty-ninth resistor R29. The other end of the sixteenth capacitor C16 is respectively connected to the third pin of the second optocoupler PC2, one end of the twenty-eighth resistor R28 and the ground. The other end of the twenty-seventh resistor R27 is respectively connected to the other end of the twenty-eighth resistor R28 and the base electrode of the ninth triode Q9. The other end of the twenty-ninth resistor R29 is respectively connected to the emitter electrode of the eleventh triode Q11, one end of the thirtieth resistor R30 and one end of the thirty-first resistor R31. The other end of the thirtieth resistor R30 is connected to the collector electrode of the ninth triode Q9, and the other end of the thirty-first resistor R31 is connected to the collector electrode of the tenth triode Q10. One end of the seventeenth capacitor C17 is respectively connected to the emitter electrode of the ninth triode Q9 and the ground, and the other end of the seventeenth capacitor C17 is connected to the negative electrode of the sixth diode D6.

The sixteenth capacitor C16, the twenty-seventh resistor R27 and the twenty-eighth resistor R28 are used for filtering the base voltage of the ninth triode Q9. The twenty-ninth resistor R29 is used for pulling the base voltage of the ninth triode Q9 up, the thirtieth resistor R30 is used for pulling the base voltage of the tenth triode Q10 up, and the thirty-first resistor R31 is used for limiting the current of the output signal PWM.

Preferably, the dimming circuit further comprises a seventh diode D7, an eighteenth capacitor C18, a nineteenth capacitor C19, a thirty-second resistor R32, a thirty-third resistor R33, a thirty-fourth resistor R34 and a thirty-fifth resistor R35. The positive electrode of the seventh diode D7 is respectively connected to the emitter electrode of the eleventh triode Q11 and one end of the eighteenth capacitor C18. The negative electrode of the seventh diode D7 is respectively connected to the collector electrode of the eleventh triode Q11 and one end of the thirty-second resistor R32. The other end of the eighteenth capacitor C18 is respectively connected to the third pin of the second optocoupler PC2 and the ground, and the other end of the thirty-second resistor R32 is connected to the base electrode of the eleventh triode Q11. One end of the thirty-third resistor R33 is respectively connected to the grid electrode of the second switching tube QB and the negative electrode of the sixth diode D6. The other end of the thirty-third resistor R33 is respectively connected to the source electrode of the second switching tube QB, one end of the thirty-fifth resistor R35 and the ground. One end of the thirty-fourth resistor R34 is connected to the drain electrode of the second switching tube QB, and the other end of the thirty-fourth resistor R34 is respectively connected to one end of the nineteenth capacitor C19 and the other end of the thirty-fifth resistor R35. The other end of the nineteenth capacitor C19 is respectively connected to the positive electrode of the sixth voltage-stabilizing tube ZDS6, one end of the thirty-fifth resistor R35 and the ground.

The eighteenth capacitor C18 is used for filtering the third voltage of 16V output by the eleventh triode Q11. Resistors R34-R35 and the nineteenth capacitor C19 are used for protect the second switching tube QB.

When implementing the present invention, a dial switch SW may also be arranged in the dimming circuit to output a corresponding dimming signal DIM+ according to a user's operation.

In conclusion, the dimming regulated power supply module and the LED dimming device of the present invention not only can output a constant voltage for supplying power to the single-chip microcomputer, but also can output an adjustable flicker-free power for achieving a smooth dimming control. Compared with the prior art, the voltage-stabilizing circuit of the present invention is simple, and the constant voltage module and the corresponding chips can be removed. Therefore, the cost is greatly lowered and the volume of the dimming regulated power supply module is significantly reduced.

The aforesaid embodiments are only used to illustrate the technical solutions of the present invention but not to limit the present invention. Although the present invention has been described in detail with reference to the aforesaid embodiments, technical solutions recorded in the aforesaid embodiments may be modified or some of the technical features may be equally replaced without departing from the principles of the present invention. Therefore, these modifications and equivalent replacements shall also fall into the scope of the present invention.

What is claimed is:

1. A dimming regulated power supply module comprising:

a control circuit, a voltage-stabilizing circuit, a dimming circuit, and an output port, wherein the control circuit converts city power into a supply voltage for supplying power to a LED light string through the output port, wherein the voltage-stabilizing circuit senses an internal voltage of the control circuit to generate a first voltage and a second voltage, and supplies power to a single-chip microcomputer in the dimming circuit after stabilizing the second voltage, wherein the voltage-stabilizing circuit outputs the first voltage to set a voltage range of the dimming circuit, wherein the output port transmits a dimming signal output by a dimmer to the dimming circuit, and wherein the dimming circuit generates a corresponding pulse-width modulation signal, wherein the control circuit controls the supply current according to the pulse-width modulation signal, thereby controls the brightness of the LED light string through the output port, wherein the voltage-stabilizing circuit further comprising:

a first diode, a second diode, a first capacitor, a second capacitor, a first triode, a second triode, a first resistor, a second resistor, a first voltage-stabilizing tube and a second voltage-stabilizing tube, wherein a positive electrode of the first diode is respectively connected to a negative electrode of the second diode and fifth pin of a transformer, wherein a negative electrode of the first diode is respectively connected to first end of the first capacitor, first end of the first resistor and a collector electrode of the first triode, wherein second end of the first capacitor is respectively connected to sixth pin of the transformer in the control circuit and first end of the second capacitor, wherein second end of the second capacitor is respectively connected to a positive electrode of the second diode and a dimming ground, wherein the base electrode of the first triode is respectively connected to second end of the first resistor and the negative electrode of the first voltage-stabilizing tube, wherein the emitter electrode of the first triode is respectively connected to the first voltage end, the collector electrode of the second triode and one end of the second resistor, wherein the emitter electrode of the second triode is connected to the second voltage end, wherein the base electrode of the second triode is respectively connected to second end of the second resistor and the negative electrode of the second voltage-stabilizing tube, wherein the positive electrode of the first voltage-stabilizing tube and the positive electrode of the second voltage-stabilizing tube are both connected to the dimming ground.

2. The dimming regulated power supply module of claim 1, wherein the voltage-stabilizing circuit further comprises:

a third resistor, a third capacitor and a fourth capacitor, wherein the third resistor is connected in parallel with the second capacitor, wherein one end of the third capacitor is respectively connected to the emitter electrode of the first triode and the first voltage end, and one end of the fourth capacitor is connected to one end of the second resistor, wherein the other end of the third capacitor is connected to the other end of the fourth capacitor and the dimming ground.

3. The dimming regulated power supply module of claim 1, wherein the dimming circuit comprises:

a first single-chip microcomputer, a first optocoupler, a third triode, a fourth triode, a fourth resistor, a fifth resistor, a sixth resistor, a seventh resistor and an eighth resistor, wherein the VDD pin of the first single-chip microcomputer is connected to the second voltage end, the ADJ pin of the first single-chip microcomputer is respectively connected to one end of the fifth resistor and one end of the sixth resistor, wherein the other end of the fifth resistor is respectively connected to one end of the fourth resistor and the first pin of the output port, and the other end of the fourth resistor is connected to the first voltage end, wherein the other end of the sixth resistor and the GND pin of the first single-chip microcomputer are both connected to the dimming ground, wherein the PWM pin of the first single-chip microcomputer is connected to the base electrode of the third triode, and the emitter electrode of the third triode is respectively connected to the dimming ground and the second pin of the first optocoupler, wherein the collector electrode of the third triode is connected to the second voltage end and the first pin of the first optocoupler, wherein the third pin of the first optocoupler is respectively connected to the emitter electrode of the fourth triode and the ground, wherein the fourth pin of the first optocoupler is respectively connected to the base electrode of the fourth triode and one end of the seventh resistor, wherein the collector electrode of the fourth triode is respectively connected to one end of the eighth resistor and the PWM pin of the dimming chip, wherein the other end of the seventh resistor is respectively connected to the other end of the eighth resistor and a third voltage end.

4. The dimming regulated power supply module of claim 3, wherein the dimming circuit further comprises:

a ninth resistor and a third voltage-stabilizing tube, wherein one end of the ninth resistor is respectively connected to the other end of the fifth resistor and the first pin of the output port, wherein the other end of the ninth resistor is connected to the negative electrode of the third voltage-stabilizing tube, and the positive electrode of the third voltage-stabilizing tube is connected to the other end of the sixth resistor.

5. The dimming regulated power supply module of claim 3, wherein the dimming circuit further comprises:

a tenth resistor, a fifth capacitor and a sixth capacitor, wherein one end of the tenth resistor is respectively connected to the ADJ pin of the first single-chip microcomputer and one end of the fifth capacitor, wherein the other end of the tenth resistor is respectively connected to one end of the fifth resistor and one end of the sixth resistor, and the other end of the fifth capacitor is connected to the dimming ground, wherein the sixth capacitor is connected between the VDD pin of the first single-chip microcomputer and the dimming ground.

6. The dimming regulated power supply module of claim 3, wherein the dimming circuit further comprises:

an eleventh resistor, a twelfth resistor and a thirteenth resistor, wherein the eleventh resistor is connected between the base electrode of the third triode and the PWM pin of the first single-chip microcomputer, the twelfth resistor is connected between the base electrode of the third triode and the emitter electrode of the third triode, and the thirteenth resistor is connected between the collector electrode of the third triode and the second voltage end.

7. The dimming regulated power supply module of claim 1, wherein the voltage-stabilizing circuit comprises:

a third diode, a seventh capacitor, an eighth capacitor, a fifth triode, a sixth triode, a fourteenth resistor, a fifteenth resistor, a fourth voltage-stabilizing tube and a fifth voltage-stabilizing tube, wherein a positive electrode of the third diode is connected to a fifth pin of a transformer, wherein a negative electrode of the third diode is respectively connected to one end of the seventh capacitor, one end of the fourteenth resistor and the collector electrode of the fifth triode, wherein the other end of the seventh capacitor is connected to one end of the eighth capacitor, and the other end of the eighth capacitor is respectively connected to a sixth pin of the transformer and the dimming ground, wherein the base electrode of the fifth triode is respectively connected to the other end of the fourteenth resistor and the negative electrode of the fourth voltage-stabilizing tube, wherein the emitter electrode of the fifth triode is respectively connected to the first voltage end, the collector electrode of the sixth triode and one end of the fifteenth resistor, wherein the emitter electrode of the sixth triode is connected to the second voltage end, and the base electrode of the sixth triode is respectively connected to the other end of the fifteenth resistor and the negative electrode of the fifth voltage-stabilizing tube, wherein the positive electrode of the fourth voltage-stabilizing tube and the positive electrode of the fifth voltage-stabilizing tube are both connected to the dimming ground.

8. An LED dimming device, comprising:

an LED light string, a dimmer, and the dimming regulated power supply module of claim 1, wherein the dimming regulated power supply module is connected to the LED light string and the dimmer, wherein the dimming regulated power supply module supplies power to the LED light string after converting the city power into a supply voltage, wherein the dimming regulated power supply module also generates a second voltage for supplying power to an internal single-chip microcomputer after stabilizing the second voltage, wherein the dimmer outputs a corresponding dimming signal to the dimming regulated power supply module, and the dimming regulated power supply module realizes the dimming control of the LED light string according to the dimming signal.

* * * * *